United States Patent [19]

Moscrip

[11] 4,413,475

[45] Nov. 8, 1983

[54] THERMODYNAMIC WORKING FLUIDS FOR STIRLING-CYCLE, RECIPROCATING THERMAL MACHINES

[76] Inventor: William M. Moscrip, 309 Ellery Ct., Fredericksburg, Va. 22401

[21] Appl. No.: 403,770

[22] PCT Filed: May 14, 1982

[86] PCT No.: PCT/US82/00648

§ 371 Date: Jul. 28, 1982

§ 102(e) Date: Jul. 28, 1982

[87] PCT Pub. No.: WO82/04098

PCT Pub. Date: Nov. 25, 1982

[51] Int. Cl.[3] ..... F02G 1/04

[52] U.S. Cl. ..... 60/521; 60/517

[58] Field of Search ..... 62/6; 60/517-526

[56] References Cited

U.S. PATENT DOCUMENTS

| | | | |
|---|---|---|---|
| 579,654 | 3/1897 | Roediger | 60/517 |
| 2,350,348 | 6/1944 | Gaugler | 62/125 |
| 2,463,130 | 3/1949 | Van Weenen | 60/517 |
| 2,465,139 | 3/1949 | Van Weenen et al. | 60/518 |
| 2,508,315 | 5/1950 | Van Weenen et al. | 60/518 |
| 2,579,702 | 12/1951 | Rinia et al. | 60/518 |
| 2,590,519 | 3/1952 | DuPre | 60/517 |
| 2,794,315 | 6/1957 | Meijer | 60/521 |
| 2,885,855 | 5/1959 | Meyer | 60/518 |
| 3,029,596 | 4/1962 | Hanold et al. | 60/659 |
| 3,080,706 | 3/1963 | Flynn, Jr. | 60/659 X |
| 3,138,918 | 6/1964 | Baker | 60/517 |
| 3,229,759 | 1/1966 | Grover | 165/105 |
| 3,315,465 | 4/1967 | Wallis | 60/518 |
| 3,364,675 | 1/1968 | Dorer | 60/517 |
| 3,458,994 | 8/1969 | Heffner | 60/521 |
| 3,458,995 | 8/1969 | Heffner et al. | 60/521 |
| 3,466,867 | 9/1969 | Brandes | 60/521 |
| 3,482,457 | 12/1969 | Wallis | 60/518 |
| 3,496,720 | 2/1970 | Neelen et al. | 60/518 |
| 3,657,877 | 4/1972 | Huttman | 60/526 |
| 3,699,770 | 10/1972 | Bennethum | 60/521 |
| 3,827,241 | 8/1974 | Almstrom et al. | 60/521 |
| 3,960,204 | 6/1976 | Horn | 165/4 |
| 4,030,297 | 6/1977 | Kantz | 60/521 |
| 4,033,130 | 7/1977 | Hermans | 60/523 |

FOREIGN PATENT DOCUMENTS

| | | | |
|---|---|---|---|
| 2820526 | 11/1979 | Fed. Rep. of Germany | 60/517 |

*Primary Examiner*—Allen M. Ostrager

*Attorney, Agent, or Firm*—W. Brown Morton, Jr.

[57] ABSTRACT

New thermodynamic working fluids with primary application to Stirling-cycle, reciprocating, thermal machines are disclosed which possess a greater dynamic heat transfer coefficient than either hydrogen or helium and which are both chemically inert and easily liquefied. A novel power level control subsystem based on the thermophysical properties of these fluids is disclosed for use in conjunction with Stirling-cycle machines; this new approach greatly simplifies procedures for changing the mean system working pressure, and thereby the instantaneous power level in such machines, during their operation.

4 Claims, 4 Drawing Figures

THERMODYNAMIC WORKING FLUIDS FOR STIRLING-CYCLE, RECIPROCATING THERMAL MACHINES

TECHNICAL FIELD

This invention relates to Stirling-cycle engines, also known as regenerative thermal machines, and more particularly to a new family of thermodynamic working fluids for such machines. The working fluids of the present invention are specifically selected with regard to whether or not they possess a high dynamic heat transfer coefficient, as defined by known empirical relations for heat transfer in turbulent flows, in addition to other requisite thermophysical properties such as chemical inertness and thermal stability. They are disclosed to be improved agents for use in all heat engines which embody a practical approximation to the well known Stirling thermodynamic cycle and which are employed in the production of both mechanical power (i.e., prime movers, compressors, fluid pumps) and refrigeration (i.e., refrigerators, air conditioners, heat pumps, gas liquefiers).

A Stirling-cycle engine is a machine which operates on a closed regenerative thermodynamic cycle, with periodic compression and expansion of a gaseous working fluid at different temperature levels, and where the flow is controlled by volume changes in such a way as to produce a net conversion of heat to work, or vice versa. The regenerator is a device which in prior art takes the form of a porous mass of metal in an insulated duct. This mass takes up heat from the working fluid during one part of the cycle, temporarily stores it within the machine until a later part of the cycle, and subsequently returns it to the working fluid prior to the start of the next cycle. Thus the regenerator may be thought of as an oscillatory thermodynamic sponge, alternately absorbing and releasing heat with complete reversibility and no loss.

A reversible process for a thermodynamic system is an ideal process, which once having taken place, can be reversed without causing a change in either the system or its surroundings. Regenerative processes are reversible in that they involve reversible heat transfer and storage; their importance derives from the fact that idealized reversible heat transfer is closely approximated by the regenerators of actual machines. Thus the Stirling engine is the only practical example of reversible heat engine which can be operated either as a prime mover or as a heat pump.

BACKGROUND

The Stirling-cycle engine was first conceived and reduced to practice in Scotland 164 years ago. A hot-air, closed-cycle prime mover based on the principle was patented by the Reverend Robert Stirling in 1817 as an alternative to the explosively dangerous steam engine. Incredibly, this event occured early in the Age of Steam, long before the invention of the internal combustion engine and several years before the first formal exposition of the Laws of Thermodynamics.

Air was the first and only working fluid in early 19th century machines, whereas hydrogen and helium have been the preferred working fluids for modern machines. In Great Britain, Europe, and the United States thousands of regenerative hot air prime movers in a variety of shapes and sizes were widely used throughout the 19th century. The smaller engines were reliable, reasonably efficient for their time, and most important, safe compared with contemporary reciprocating steam engines. The larger engines were less reliable, however, because they tended to overheat and often succumbed unexpectedly to premature material failure.

Toward the end of the 19th century the electric motor and the internal combustion engine were developed and began to replace not only the Stirling-cycle engines, but also the reciprocating steam engines of that era. These new machines were preferred because they could produce greater power from more compact devices and because they were more amenable to simple power level controls. Both of these limitations of the original Stirling engine are directly attributable to the use of air as the working fluid. That is, the specific power capacity and the overall mechanical complexity of a practical Stirling-cycle machine are direct consequences of the inherent performance characteristics and heat transfer properties of the working fluids used.

Since World War II there have been unprecedented adances in the general technologies of machine design, heat transfer, materials science, system analysis and simulation, manufacturing methods, and Stirling engine development. Today, in comparison to their conventional internal combustion counterparts, all modern Stirling-cycle prime movers are external combustion engines which consistently demonstrate (in the laboratory) higher efficiency, multifuel capability, lower exhaust emissions, quieter operation, equivalent power density, and superior torque characteristics. Nevertheless, none of these engines is mass produced for any commercial application anywhere in the modern world.

The reason for this is that contemporary Stirling engines have been developed largely by adapting traditional methods and designs from the more familiar internal combustion engine technology base. Patchwork adaptation of the old as a shortcut path to the new is a process which inexorably produces a hodge-podge arrangement of excessive mechanical complexity and which inevitably results in high production costs.

The use of hydrogen and helium has led to increased power density, but it has also required the use of complex seals, makeup storage vessels, expensive materials, and elaborate controls. Hydrogen, in particular, is difficult to contain and causes ordinary engine materials to become brittle. Despite clearly superior technical performance characteristics, therefore, contemporary Stirling engines are invariably not cost competitive from the standpoint of economical mass production.

The invention comprises fundamental concepts and material properties which are used in combination to form a new and less complicated technology base for the development of improved Stirling-Cycle machines, specifically including the following: (1) working fluids other than hydrogen, helium, or air, namely certain fluorine compounds exemplified by sulfur hexafluoride, perfluorobutane, perfluoropropane, and octafluorocyclobutane, which provide an increased dynamic heat transfer coefficient yet are nonflammable, non-toxic, and easily liquefied; and (2) an engine power level control subsystem by which the mean system working pressure, and thereby the instantaneous power level of the engine, is conveniently varied by the hydraulic injection or ejection of condensed working fluid through a special heat exchanger to be known as the reservoir cooler.

It is a primary object of the invention to provide a new and improved family of thermodynamic working fluids for Stirling-cycle, reciprocating, thermal machines, other than the usual hydrogen, helium, or air which possess increased dynamic heat transfer coefficients; have a critical temperature somewhat above the minimum ambient temperature of the available heat sink yet somewhat below the designated heat rejection temperature of the cycle as maintained within the engine cooler; and which are also nonflammable, nontoxic, and inexpensive, inert, and of low viscosity.

It is a further object of the invention to provide an engine power level control subsystem for use in conjunction with any regenerative thermal machine by means of which the nominal operating pressure of the cycle is conveniently and automatically varied as a direct function of power demand by the hydraulic injection or ejection of condensed working fluid through a special heat exchanger to be known as the reservoir cooler.

BRIEF DESCRIPTION OF DRAWINGS

Other objects, advantages, and novel features of the invention will become readily apparent upon consideration of the following detailed description when read in conjunction with the accompanying drawings wherein:

FIG. 2(*c*) is a pressure-volume diagram which depicts the working of an actual machine;

BEST MODE FOR CARRYING OUT INVENTION

Figure 1:
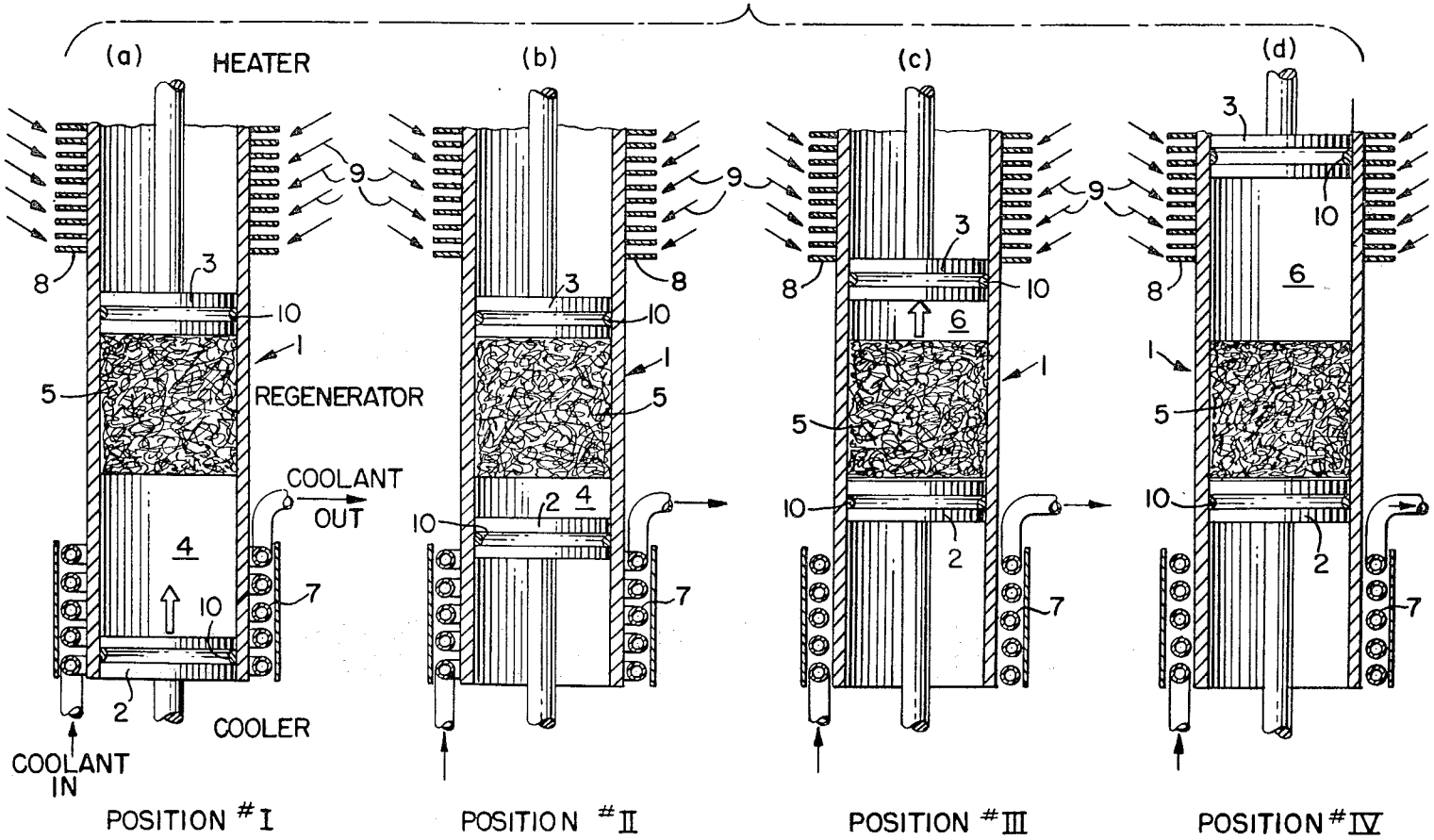
FIG. 1 is an illustration of the operational sequence of events during one complete cycle of an idealized single-acting two-piston Stirling engine used in the prime mover mode.

Attention is directed to FIG. 1 wherein numeral 1 designates an idealized version of a two-piston Stirling-cycle prime mover. A conceptually constant mass of pressurized gaseous working fluid occupies the working volume between the compression piston 2 and the expansion piston 3. The total working volume is comprised by compression space 4, regenerator 5, and expansion space 6. A portion of compression space 4 is continually cooled by cooler 7, while a portion of expansion space 6 is continually heated by heater 8. Arrows 9 are intended to represent the input of heat by conduction, convection, or radiation. Escape of fluid from the working volume is prevented by the piston seals 10.

During the compression stroke (between positions I and II) the working fluid is compressed isothermally by piston 2 at the minimum temperature level of the cycle. Heat is continually rejected at this temperature through cooler 7; the pressure rises slightly and the total working volume decreases to a minimum. During the forward displacement (cold-side to hot-side transfer) stroke (between positions II and III) regenerator 5 yields stored heat to the working fluid as it is transferred to expansion space 6 with the volume remaining constant. The temperature and pressure rise to their maximum levels.

During the expansion stroke (between positions III and IV) the working fluid expands isothermally at the maximum temperature level of the cycle, doing work on piston 3. The temperature level is maintained by the input of heater 8; the pressure drops and the total working volume increases to a maximum. During the reverse displacement (hot-side to cold-side transfer) stroke (between positions IV and I) regenerator 5 recovers heat from the working fluid as it is transferred to compression space 4 with the volume remaining constant. The temperature and pressure return to the starting levels of the cycle.

Figure 2:
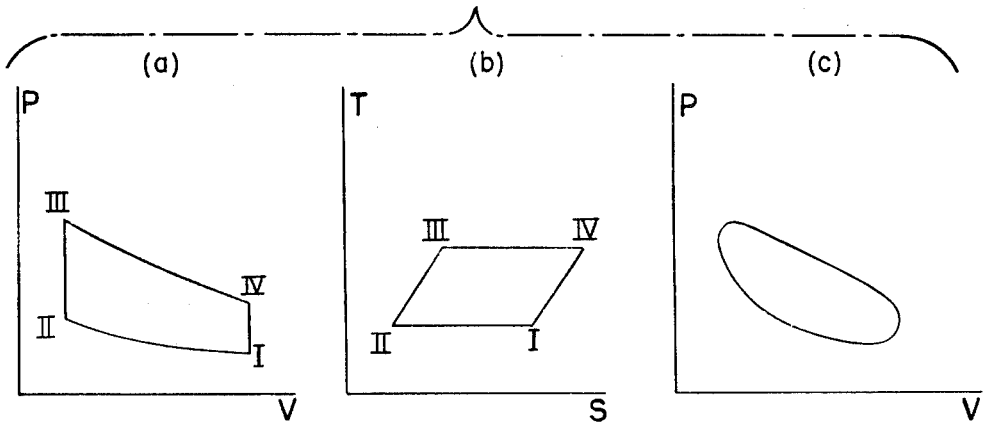
FIG. 2(*a*) and FIG. 2(*b*) are schematics which illustrate the idealized pressure-volume and temperature-entropy diagrams of the thermodynamic cycle of the working fluid in the same machine depicted by FIG. 1.

A clearer understanding of the foregoing may be obtained by referring to the diagrams of FIG. 2(*a*) and FIG. 2(*b*) wherein the same complete cycle is presented in terms of the pressure-volume diagram and the temperature-entropy diagram for the working fluid. For each process as depicted by the curves between the indicated position numbers I–II, II–III, III–IV, and IV–I, the area under a curve on the P-V diagram is a representative measure of the mechanical work added to or removed from the system during the process. Similarly, the area under a curve on a T-S diagram is a measure of the heat transferred to or rejected from the working fluid during the process.

Actual machines differ fundamentally from the idealized versions in that the motion of each piston is continuous and smooth, rather than discontinuous and abrupt. This causes the indicated processes of FIG. 2(*a*) and FIG. 2(*b*) to overlap one another, and results in P-V diagrams which are smooth continuous curves devoid of sharp corners as shown by FIG. 2(*c*). Thus the piston motion of actual machines is smoothly periodic to the point of being sinusoidal, and the working fluid is likewise distributed in a periodically time-variant manner throughout the total working volume. The instantaneous phase angle between the relative motions of the two pistons is a critical parameter in the operation of real machines and usually has a value on the order of 90 degrees.

The processes of compression and expansion in real machines are not strictly isothermal, which constitutes another major departure from the ideal. The provision of heater 8 adjacent to expansion space 6 and of cooler 7 adjacent to compression space 4 effects only a crude approximation to the isothermal condition. Additionally, the presence of these elements tends to increase the unswept or dead volume ratio, which has a critically adverse effect on performance. Moreover, the working fluid is heated or cooled, not only when flowing in the correct direction between regenerator 5 and either expansion space 6 or compression space 4, but also when flowing in the respective opposite directions. Nevertheless, extant Stirling engines exhibit comparable power densities and significantly greater efficiencies than conventional internal combustion engines of all types.

One favorable embodiment of the present invention is the utilization of alternative working fluids which provide increased performance, greater safety, and improved reliability. From a historical standpoint there appear to be only three working fluids of significant interest for application in regenerative thermal machines: air, helium, and hydrogen. Air was and still is of interest primarily because of its universal availability. But helium and hydrogen are the normal working fluids of choice in the prior art because their thermophysical properties are such as to permit high rates of heat transfer and flow to occur, with relatively low viscous flow losses, compared to air.

Under standard conditions of temperature and pressure, for example, relative values for the thermal conductivity, heat capacity, and gaseous viscosity are 6.45/5.47/1.00, 14.31/5.16/1.00, and 0.47/1.06/1.00 for hydrogen, helium, and air respectively. In terms of engine performance, therefore, hydrogen is better than helium, and is also very much less expensive. On the other hand, hydrogen is dangerously combustible in the presence of air or oxygen, tends to destructively embrittle common engine construction materials, and is the most difficult of all elements to confine under pressure.

The pre-eminence of hydrogen and helium as working media for modern Stirling-cycle machines derives from the need to maximize the rates of heat transfer and minimize flow losses, or drag, in high performance applications. The complexities of fluid flow phenomena which include unsteady heat, mass, and momentum transport are analytically intractable for even a simple boundary geometry. Realistic engineering design and development must therefore rely heavily on empirical methods and equations, which in some cases are well developed and reasonably accurate.

It is known, for example, that the rate at which heat is exchanged between a solid wall and a fluid can be described by the equation: $Q = h \times A \times dT$. Here Q is the heat flow rate, A is the heat transfer surface area, dT is some characteristic temperature difference, and h is a heat transfer coefficient defined empirically for various types of flow. Thus, for a fixed boundary condition and given surface temperatures, maximum rates of heat transfer result from high heat transfer coefficients. It is also well known that the heat transfer coefficient for heat exchange between a fluid and a long tube (length/diameter > 10) may be accurately described by the following empirically derived equation:

$$h = 0.026 \times (k/D) \times (DxVxd/v)\text{exp}0.8 \times (Cpxv/k)\text{exp}0.33$$

Here k is the fluid thermal conductivity, D is the tube diameter, V is the velocity of flow, d is the fluid density, v is the absolute viscosity, and Cp is the specific heat capacity.

Figure 3:
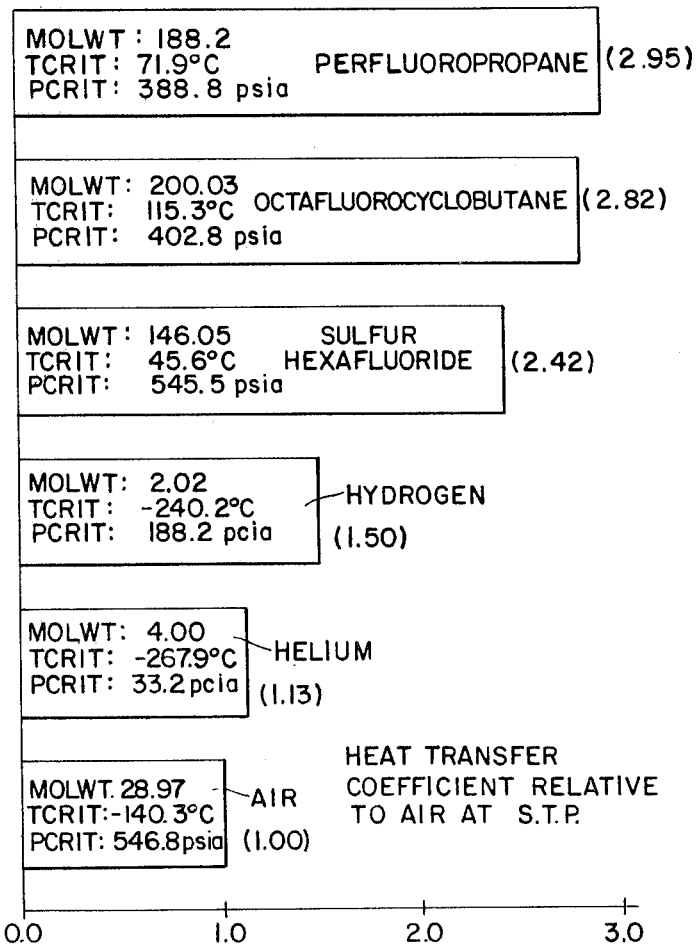
FIG. 3 is a bar graph comparison of the dynamic heat transfer coefficient calculated for various gaseous working fluids relative to air.

Therefore, it is an important specific teaching of this invention that by means of this relationship, and by choosing a representative flow velocity and tube diameter for purposes of comparison, it can be demonstrated that certain gases other than hydrogen or helium are superior heat transfer media. Results for some selected fluorine compounds, namely sulfur hexafluoride, perfluoropropane, and octafluorocyclobutane are illustrated by the graph of FIG. 3. Although the indicated values were derived from data for these gases at room temperature and atmospheric pressure, a similar calculation made for the nominal operating conditions of a Stirling cycle prime mover, i.e. a temperature of 750° C. and a pressure of 20 MPa (2900.74 psia), indicates that the heat transfer coefficient for sulfur hexafluoride is nearly twice (1.8) that for hydrogen under the same conditions.

The three alternative working fluids suggested by FIG. 3 are nontoxic, nonflammable, and easily liquefied under pressure at room temperature, which leads to improved safety and ease of handling. They are also chemically and thermally stable, and generally possess a much higher molecular weight compared to hydrogen or helium. According to Graham's Law the rate at which gases tend to diffuse through very small openings is inversely proportional to the square root of their density. Thus these high molecular weight gases present a far less difficult reciprocating seal design problem compared to either hydrogen or helium, and a far greater quantity of makeup fluid can be stored in a given volume as a liquefied gas than as a pressurized gas.

Another reason often given for choosing hydrogen or helium over other gases as a working fluid is that their low viscosity automatically result in the lowest possible viscous flow losses. But the empirically derived dimensionless parameter known as the Reynolds Number, which is well known to those skilled in the science of fluid mechanics to equal Density × Speed × Size/Viscosity, is a measure of the ratio of inertial forces in a flow to viscous forces in the flow. This means that at low Reynolds Number flows, viscous effects in the flow dominate the inertial effects in the flow and vice versa. But it is also well known that most common examples of high performance thermal machines, including Stirling-cycle engines, operate generally in a high Reynolds number flow regime where inertial effects are known to dominate viscous effects.

And although the fluid viscosity surely is not irrelevant in high Reynolds Number flows, an approximate experimental law for drag in such flows is known to be: Drag = (Speed)exp2 × Density × (Size)exp2. This means that the choice of a working medium which possess a higher heat transfer coefficient will, for a given heat flow rate or power level, require a lower fluid velocity (Speed) and/or a smaller wetted heat transfer surface area (Size), and will therefore result in a lower fluid drag, not withstanding the value of the fluid viscosity, and to a lesser extent, the density of the medium.

It is for these reasons that the invention proposes the utilization of the indicated compounds, and others, as alternative working fluid media in the Stirling-cycle engine. The essence of this concept is the novel recognition that such working fluids should be selected primarily with regard to whether or not they exhibit a high dynamic heat transfer coefficient, outstanding chemical and physical inertness, and the requisite critical properties to facilitate liquefaction under normal operating conditions. In addition are the enormous advantages of simplicity and safety inherent in the storage and handling of a nontoxic, nonflammable, inert liquid at low pressures, when compared with the storage and handling of dangerously flammable and chemically active hydrogen at high pressures. Thus, it is apparent that this teaching of my invention is away from the teaching of the prior art and was not at all obvious at the time.

Another favorable embodiment of the invention is an engine power level control subsystem, to be used in conjunction with the operation of any regenerative thermal machine, by means of which the mean system operating pressure can be rapidly and automatically varied as a function of power demand. In the case of a modern, but conventional, high-performance, Stirling-cycle engine, the operating power level is normally controlled by simultaneously adjusting both the quantity of heat input to the heater head and the mean working pressure of the cycle, since it is these variables which most directly influence the power level. The first of these is accomplished by means of a combustion control subsystem quite similar in function to the familiar accelerator/throttle linkage of the automotive internal combustion engine, except that the time response is much slower due to the large thermal mass of the heat transfer components.

The second, however, currently requires a complex pressure control subsystem consisting of pressurized heavy wall stainless steel hydrogen gas bottles; sophisticated servoactuated high pressure flow control valves; an array of essential and specially designed check valves, stop valves, bypass valves, relief valves, gauges, and the like; and a high-capacity, hydrogen-compatible compressor as described in prior art patents filed under Subclass 521 of Class 60. (see for example U.S. Pat. Nos. 3,699,770; 3,827,241; or 4,030,297). In short, the control subsystem required to vary the power level of prior art Stirling-cycle engines are both complicated and costly, and they represent a critical stumbling block to the economical use and the widespread acceptance of these engines. This is particularly true today with respect to prime movers which might be sold in the highly competitive worldwide automotive market.

One of the primary technical ramifications of the usual working pressure control subsystem in such applications may be described as an inherent accelerator time lag or "hesitation". The time response of existing compressor-dependent systems is poor, because the compressor must handle a comparatively large volume of gas in order to effect a small change in the mean system pressure. This is fundamentally unavoidable in such a system, as the bulk modulus of a gas is by nature extremely low. It is therefore an accepted practice to accomplish a rapid transition from low power demand to high power demand by maintaining the gas reservoir at a pressure substantially greater than the maximum working pressure of the cycle. The force of this greater pressure is then relied upon to rapidly inject additional gas into the working volume whenever an increase in power output is indicated.

As will be appreciated by those familiar with the art, the transistion in the reverse direction from a high power demand condition to a low power demand condition is less easily achieved. Since the time required is typically on the order of 5 to 20 seconds, depending on the engine's speed and the degree of change required, additional control valves are sometimes employed to temporarily short circuit the normal flow path between the cyclinders to achieve a more rapid decrease in power output. The basic feasibility of this type of power level control subsystem has been demonstrated in the laboratory, but it is an undesirable solution to the general problem because it forces the system design in the wrong direction toward an even greater complexity and cost.

Figure 4:
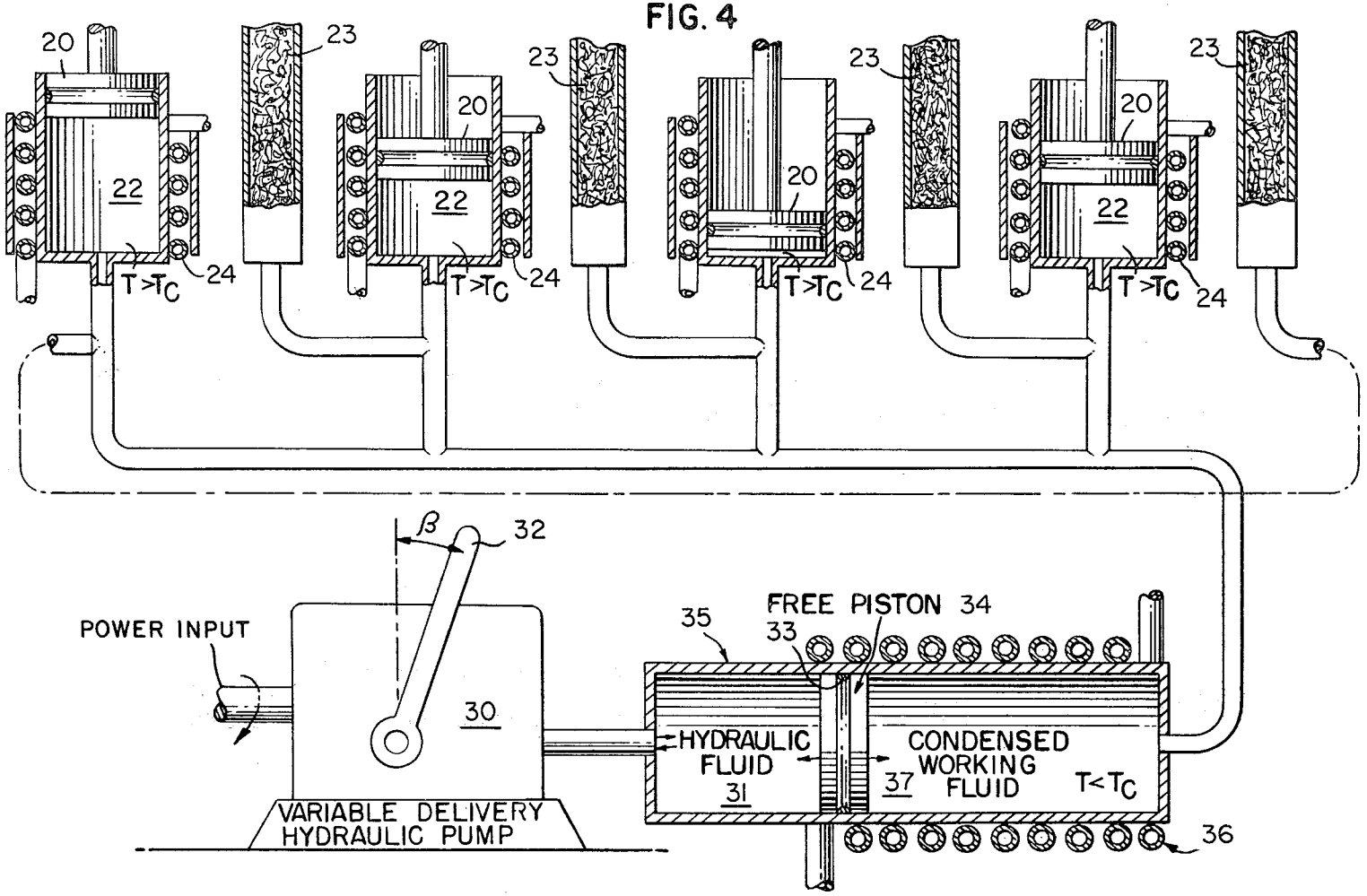
FIG. 4 is a schematic representation of means for controlling the instantaneous power level of a Stirling-cycle machine by adjusting the mean operating pressure.

Attention is now directed to the schematic illustration of FIG. 4 wherein a novel power level control subsystem is depicted which is deliberately intended to operate in a single-component two-phase mode. This system is similar to the prior art in that it operates on the well-known principle that a change in the steady state power level of a Stirling engine is virtually a direct linear function of a change in the mean operating pressure of the gaseous working fluid contained therein. But it is radically different from previous systems in that the working fluid is intended to undergo a change in phase whenever it is added to or withdrawn from the working volume. Thus it is another important specific teaching of this invention that a rapid transition from a condition of low power demand to some other condition of high power demand may best be accomplished by the rapid injection of working fluid into the working volume in the form of a virtually incompressible liquid.

It may be seen that one preferred embodiment of such a power level control subsystem is comprised by a servo-actuated variable displacement hydraulic pump 30, a power demand control mechanism or accelerator 32, free piston 34, fluid reservoir 35, reservoir cooler 36, and a plurality of Stirling cycle engine coolers 24. When an increased demand for power output is indicated by a change in the setting of accelerator 32, pump 30 forces hydraulic fluid 31 into reservoir 35 which in turn forces piston 34, sealed by o-ring 33, to move to the right. This action causes the rapid injection of condensed liquid working fluid 37 into the working volume at points of entry contiguous with coolers 24. The change in mean operating pressure is immediate, because the introduction of nearly incompressible liquid medium in this manner instantly lowers the total working volume available to the gaseous medium. As the injected liquid is subsequently evaporated by heat transferred within engine coolers 24, the available volume gradually returns to its former value, but only as the pressure level is increased by the generation and presence of additional vapor. Thus both the increased mean operating pressure and therefore a higher output power level are sustained.

The reverse transition from a condition of high power demand to a condition of lower power demand is also rapidly accomplished by a reverse change in the setting of accelerator 32. This occurs by means of the simple venting of a portion of the gaseous working fluid back to reservoir 35 when pump 30 reverses its direction of flow, since reservoir 35 is maintained at a pressure below the minimum working pressure of the system, and at a temperature less than that of engine coolers 24. Thus it should be apparent to those skilled in the art that two essential prerequisites for the successful implementation of the proposed power level control system are the presence of an additional heat exchanger shown in FIG. 4 as reservoir cooler 36 and the utilization of a working fluid which possesses a critical temperature, Tc, between the normal operating temperature of coolers 24 and that of reservoir Cooler 36.

Each engine cooler 24 is maintained at a temperature sufficiently low for good Stirling-cycle thermodynamic efficiency, but at a temperature somewhat above Tc so that its funtion from the standpoint of power control is always that of an evaporator. On the other hand, reservoir cooler 36 and therefore reservoir 35 must be maintained at a temperature somewhat below Tc so that its function is always that of a condenser. Thus the pressure in reservoir 35 is the saturated vapor pressure of the condensed working fluid at that temperature.

It is perhaps appropriate at this point to emphasize that the liquid phase is therefore present within the working volume of the machine only in the region of each engine cooler dead volume (excluding most of the compression space 22) and for short periods of time during increasing power output transients. A reduction in the overall system complexity and cost, coupled with a dramatic increase in the system time response, can be expected to result from this approach to the design of a Stirling engine power level control device. From a practical engineering standpoint, the business of effecting and controlling the flow of a high bulk modulus liquid by means of a low capacity positive displacement pump is preferable to the business of effecting and controlling the equivalent mass flow in the form of a low bulk modulus gas by means of a high capacity compressor.

Since the closed cycle Stirling prime mover operates on the basis of the difference in temperature in the working fluid between the hot expansion space and the cold compression space, the development of useful power output is not specific to the source of heat available for use. Therefore the design of the heat source can be any one of a large variety of possible types. A rather simple combustion system can be produced, for example, which will cleanly and efficiently burn various kinds of both liquid fuels and gaseous fuels without any modification whatsoever. Thus it will be appreciated by those familiar with the art that a single prime mover may be made to operate on regular or premium gasoline, diesel oil, alcohol, crude oil, lubricating oil, olive oil, vegetable oil, propane, butane, natural gas, and synthetic coal gas.

It is important at this point to re-emphasize the fact that each small segment of a well-designed regenerator transfers heat to and from the working fluid with minimal temperature differences. Thus all stages in the regenerator are reversible in an actual thermodynamic sense. Therefore, the entire machine cycle is reversible in function; that is, the direction of flow of heat and work can be reversed. The Stirling engine is truly unique in that it is the only practical example of a thermodynamically reversible machine.

It should be thoroughly understood, therefore, that many of the design concepts disclosed herein for Stirling prime movers are also applicable to the design and development of Stirling refrigerators, heat pumps, air conditioners, and the like. It is another important specific teaching of this invention that machines of this kind would be appreciably more efficient than conventional vapor cycle reciprocating refrigerators or thermally-activated absorption refrigerators, with a substantial savings in size and weight. In addition, a hydrid device obtained from the combination of a Stirling prime mover mechanically coupled to a Stirling heat pump will permit both multifuel and non-fuel powered refrigeration units to be developed and applied to specialized applications.

In view of the foregoing it should be readily apparent to those skilled in the art that the operation of the present invention may be accomplished by means of and in the context of an enormous variety of diverse applications. In fact, virtually every market in the world which is currently occupied by the application of a reciprocating internal combustion prime mover, or by the application of a conventional vapor cycle, absorption, or other type of refrigeration device, is subject to improvement by virtue of the diligent application of the teachings of this invention.

These include but are by no means limited to the following: automotive prime movers, marine prime movers, aeronautical prime movers, astronautical prime movers, industrial prime movers, military prime movers, agricultural prime movers, multifuel prime movers, nonfuel prime movers, portable prime movers, biomedical prime movers, refrigerators, air conditioners, cryogenic cooling engines, residential heat pumps, industrial heat pumps, military heat pumps, water coolers, air compressors, other gas compressors, remote electric generators, portable electric generators, stationary electric generators, hydroelectric power converters, nuclear power converters, radioisotope power converters, solar power converters, geothermal power converters, ocean thermal power converters, biomass power converters, solid waste power converters, small cogeneration power plants, large cogeneration power plants, remote fluid pumps, portable fluid pumps, stationary fluid pumps, remote power tools, portable power tools, outdoor power tools, underwater power tools, toys and novelties.

Obviously, many modifications and variations of the present invention may occur to those skilled in the art in the light of the above teachings. Indeed, every potential application of a Stirling-cycle engine which may be accomplished by machines operating on the principles set forth herein is, in and of itself, a unique and special variation of this invention. It is therefore to be understood that within the scope of the appended claims the invention may be practiced otherwise than as specifically described.

I claim:

1. A Stirling-cycle, reciprocating, thermal machine in which the internal working fluid is a gas that has a molecular weight substantially greater than that of air, is non-toxic, nonflammable, chemically and thermally stable, with a heat transfer coefficient substantially greater than that of hydrogen at machine operating temperatures and pressures and can be easily liquefied under pressure at room temperature, and comprising a control system including means for varying the main system mean operating pressure by rapid injection of working fluid from a reservoir into the working volume as a liquid to increase that pressure and by withdrawal of working fluid as a gas from that working volume and its condensation in the reservoir to reduce that pressure.

2. A machine according to claim 1 in which the reservoir is maintained at a temperature below, and the working volume at a temperature above, the critical temperature of the working fluid.

3. A machine according to claim 2 in which the reservoir comprises a cylinder space and a free piston slidable in said space having condensed working fluid on one side and hydraulic control fluid on the other side.

4. A machine according to claim 3 which comprises means to augument or diminish the volume of hydraulic fluid in the cylinder in response to changes in the setting of an accelerator.

* * * * *